US006443065B1

(12) United States Patent
Charette et al.

(10) Patent No.: US 6,443,065 B1
(45) Date of Patent: Sep. 3, 2002

(54) PLATE CYLINDER, EXTERNAL PLATE REGISTER TOOL, AND METHOD OF REGISTERING PLATES

(75) Inventors: William Albert Charette, Rollinsford; John James Sposato, Jr., Somersworth; Lev Zlatin, Exeter; Charles Henry Dufour, Durham, all of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/572,175

(22) Filed: May 17, 2000

(51) Int. Cl.[7] ..... B41F 27/12

(52) U.S. Cl. ..... 101/415.1; 101/378; 101/486; 101/DIG. 36

(58) Field of Search ..... 101/415.1, 378, 101/479, 382.1, 383, 384, 481, 485, 486, DIG. 36

(56) References Cited

U.S. PATENT DOCUMENTS 4,748,911 A * 6/1988 Kobler ..... 101/378
5,317,971 A * 6/1994 Deye, Jr. et al. ..... 101/486
5,379,694 A * 1/1995 Haek et al. ..... 101/415.1
5,419,248 A * 5/1995 Brotzman ..... 101/378
5,429,048 A 7/1995 Gaffney et al. ..... 101/217
5,533,446 A * 7/1996 Hashimura et al. ..... 101/477

* cited by examiner

*Primary Examiner*—Leslie J. Evanisko
(74) *Attorney, Agent, or Firm*—Davidson, Davidson & Kappel, LLC

(57) ABSTRACT

A plate cylinder comprising a cylinder body having at least one external slot extending axially with respect to the cylinder body, and at least one register pin slidable by an external registration device within the slot. Also provided is an external registration device comprising a base for attaching to a periphery of a plate cylinder, and a pin pusher interacting with a register pin in a slot of the plate cylinder, the pin pusher being axially movable relative to the base. A method is provided for registering plates on a plate cylinder comprising the steps of placing an external registration device on a plate cylinder having at least one register pin, and moving the register pin axially with the external registration device.

18 Claims, 6 Drawing Sheets

PLATE CYLINDER, EXTERNAL PLATE REGISTER TOOL, AND METHOD OF REGISTERING PLATES

BACKGROUND OF THE INVENTION

1. Field of the Invention

The present invention relates generally to printing presses and more particularly to a plate cylinder for a printing press as well as to a tool and a method for registering plates on the plate cylinder.

2. Background Information

Printing presses may print a continuous web of material, such as paper. A plate cylinder of the printing press may firmly hold or lock-up a flat printing plate, for example a lithographic printing plate. An image to be printed is formed by ink which is transferred from the printing plate to the paper. In offset printing presses the plate first transfers ink to a blanket and then to the paper.

For an image to be printed properly, the plate must be properly registered on the plate cylinder. To permit proper axial registration, the printing plate must be axially movable with respect to the paper or other material to be printed.

In prior art devices, the plate may be fastened first to the plate cylinder and the entire plate cylinder moved axially to provide proper axial register.

For large newspaper and other presses, it often is desirable to have more than one printing plate spaced axially about the plate cylinder, so that, for example, four sections can be printed. It then becomes desirable to be able to register each printing plate independently, so that proper register for each plate can be provided. However, solely moving the plate cylinder does not provide for independent registration.

Moreover, even for single plate cylinders, axial registration devices are often complicated and expensive.

BRIEF SUMMARY OF THE INVENTION

An object of the present invention is to provide a plate cylinder which provides for simple registration of a printing plate. Another alternate or additional object of the present invention is to provide an external registration tool for registering plates on a plate cylinder. Yet another alternate or additional object of the present invention is to provide a simple method for registering printing plates on a plate cylinder. Still another alternate or additional object of the present invention is to provide for independent registration of a plurality of plates on a multi-plate plate cylinder.

The present invention provides a plate cylinder comprising a cylinder body having at least one external slot extending axially with respect to the cylinder body, and at least one register pin slidable by an external registration device within the slot.

A spring element interacting with a rotatable actuator can permit axial movement of the register pins within the slot when the actuator is in a first position, and can lock the register pins in the slot when the actuator is in a second position.

By permitting for an external device to move the pins, the printing plate or press itself does not need to contain the registration mechanism. Thus a simpler and more efficient construction of the plate cylinder can result. In particular at high press speeds, such as 2500 feet per minute or greater, the simpler construction can provide reduced plate cylinder vibrations and improved print qualities.

The plate cylinder is preferably a multi-plate plate cylinder including at least two independently movable register pins.

By permitting each pin to be moved externally and independently from the other pins, simple register of each plate on the plate cylinder can be provided.

The register pin may fit within a slot of the spring element. The spring element preferably comprises two separate springs, one being of low stiffness and the second of higher stiffness. The first low stiffness spring yields a low resistance to sliding the pin, so that a controlled move of the pin can be made. The second spring with a higher stiffness is deformed by a rotation of the actuator. The actuator preferably is an eccentric rod.

The plate cylinder also preferably has location holes or markings for allowing proper placement of the external registration device.

The present invention also provides a printing press comprising a plate cylinder having at least one external slot, the plate cylinder having a register pin slidable in the slot, and an external registration device for sliding the register pin within the slot.

Preferably, the plate cylinder is a multi-plate plate cylinder having a plurality of register pins. The press preferably is a lithographic offset printing press, including a blanket cylinder interacting with the plate cylinder. The simple construction of the plate of the present invention is particularly advantageous when used in combination with a gapless blanket. U.S. Pat. No. 5,429,048 is hereby incorporated by reference herein as an example of an offset lithographic printing press with a removable gapless blanket.

The present invention also provides for an external registration device including a base for attaching to a periphery of a plate cylinder and a pin pusher interacting with a register pin in a slot of the plate cylinder, the pin pusher being axially movable relative to the base.

The base is preferably attached to the plate cylinder using location pins, which interact with location holes in the plate cylinder. Alternately or additionally, the base may be magnetic to be firmly held on the plate cylinder during a registration adjustment.

The pin pusher preferably is movable axially with respect to the base through a nut and screw arrangement. The pin pusher may thus function as a nut by having an internally threaded hole, while an axially extending rod has external threads and function as the screw. An adjustment knob for fine control of the rotational position of the rod can be attached to one end of the rod. Thus by rotation of the adjustment knob, the pin pusher can be axially adjusted to move the registration pin.

The present invention also provides a method for registering plates on a plate cylinder comprising the steps of:

placing an external registration device on a plate cylinder having at least one register pin, and moving the register pin axially with the external registration device.

The method also preferably includes the step of providing a printing plate having a notch for interacting with the register pin to the plate cylinder, and most preferably to providing a plurality of printing plates to the plate cylinder, the plates being spaced axially apart from one another.

BRIEF DESCRIPTION OF THE DRAWINGS

An embodiment of the present invention is described below by reference to the following drawings, in which.

DETAILED DESCRIPTION

Figure 1:
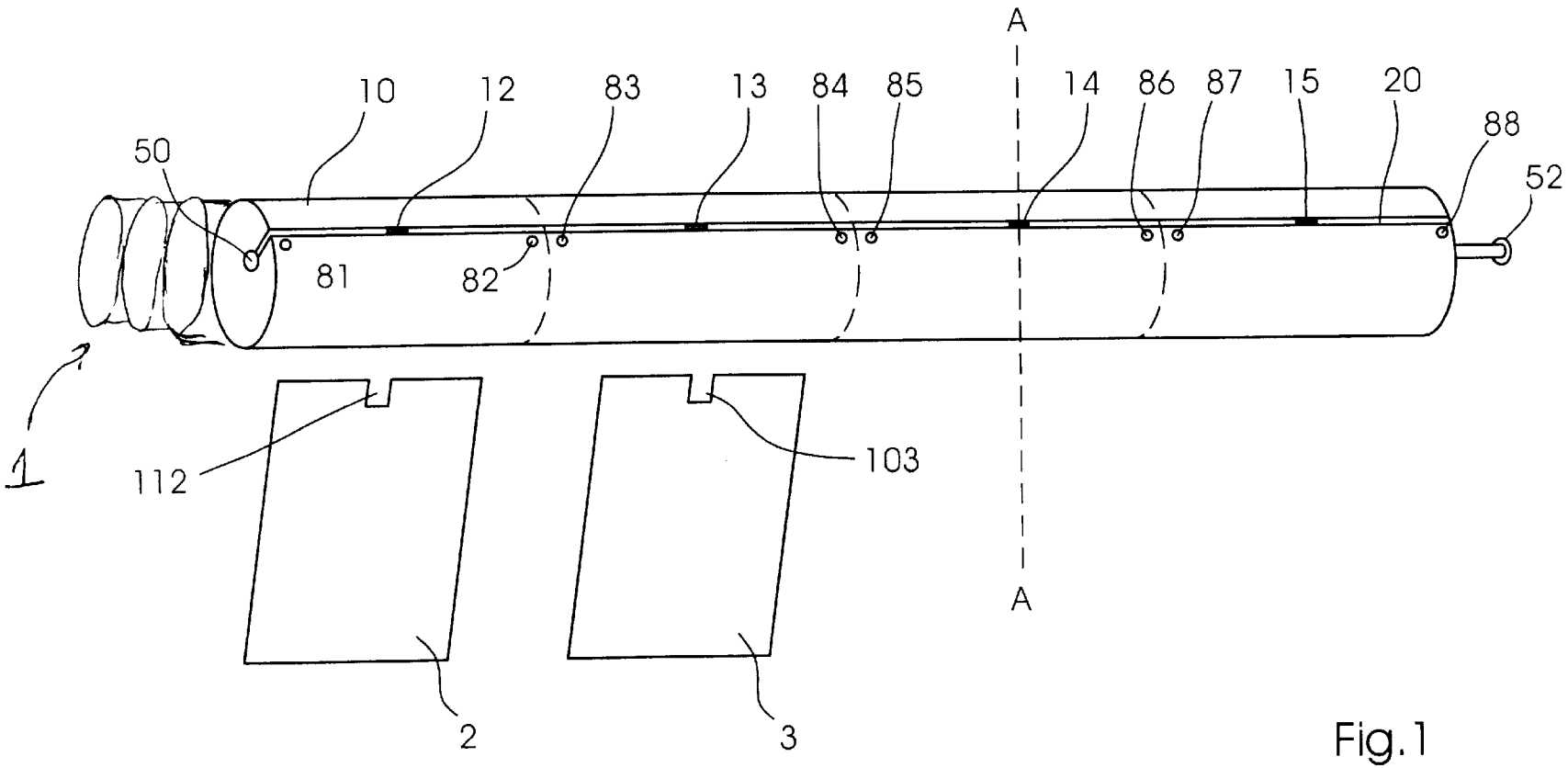
FIG. 1 shows a view of a plate cylinder according to the present invention, with printing plates not yet attached.

FIG. 1 shows a plate cylinder 10 of a printing press 1 according to the present invention, plate cylinder 10 capable of carrying four printing plates, such as plates 2, 3. Plate cylinder 10 includes four register pins 12, 13, 14, 15, axially slidable within a slot 20 which opens at the outer surface of cylinder 10.

Figure 2:
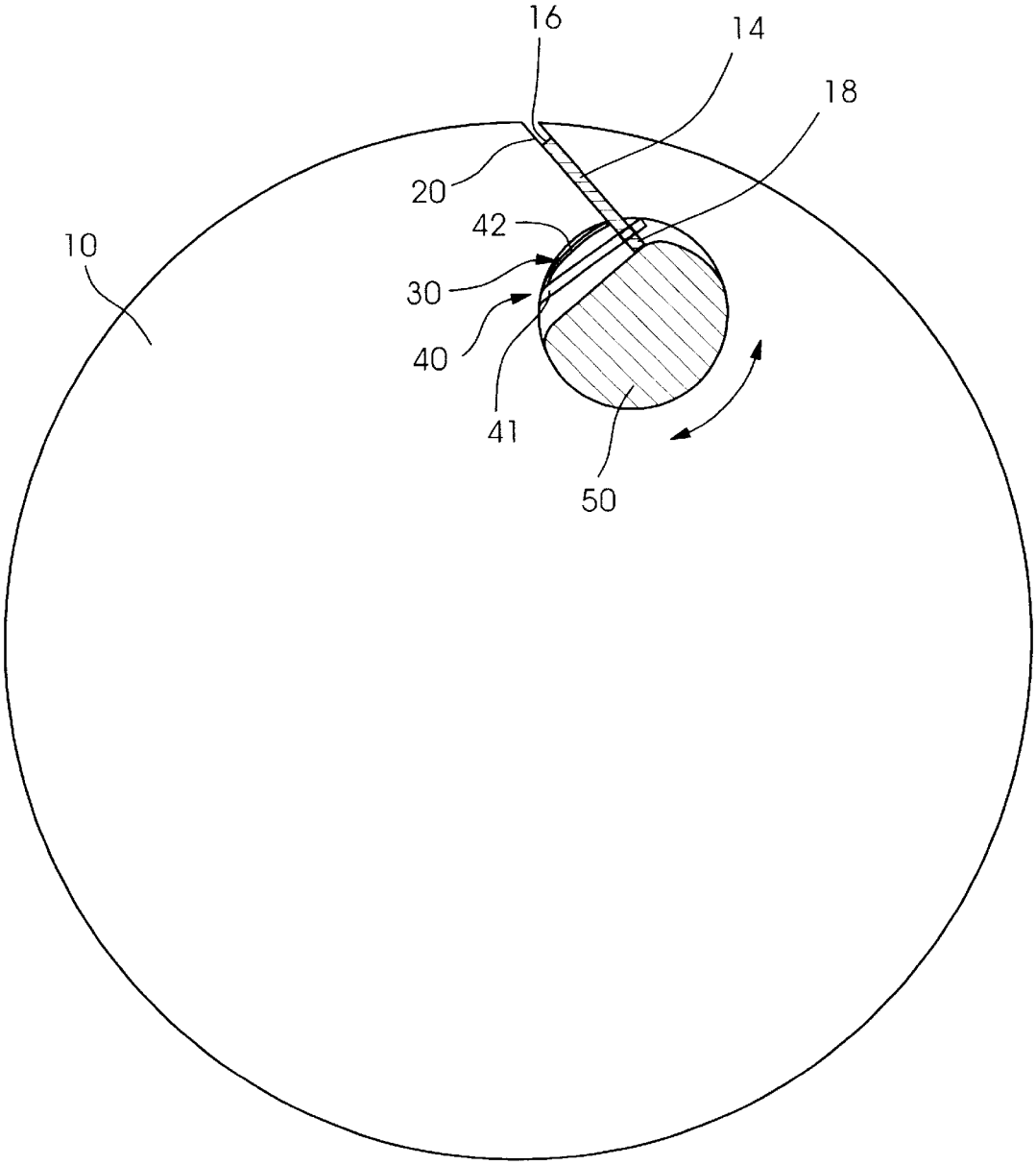
FIG. 2 shows a cross-section side view of the end of the print cylinder through line A—A of FIG. 1, with a register pin a movable position.

FIG. 2 shows a cross-section view of cylinder 10 along line A—A of FIG. 1. Register pin 14 fits in slot 20, so that a head section 16 fits within slot 20 and a tail section 18 extends beyond slot 20 into an axially extending bore hole 30. Tail section 18 extends as well through an aperture in a first spring 41 located within hole 30. A second spring 42 of lower stiffness than spring 41, which preferably has a high stiffness, bends between the base of spring 41 and the tail section 18.

Figure 5:
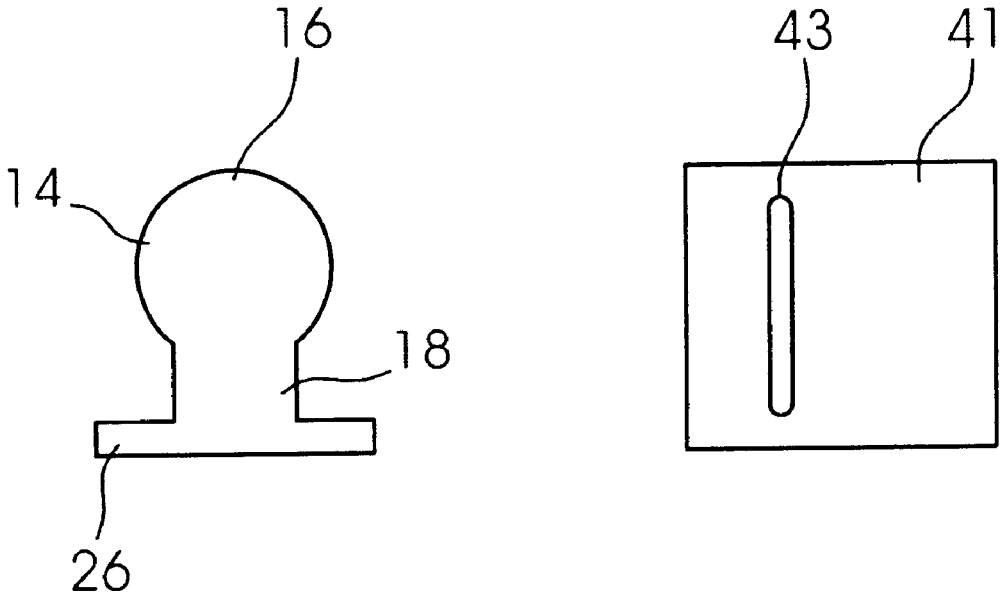
FIG. 5 shows a register pin, a high stiffness spring of the spring mechanism.

FIG. 5 shows a possible shape of register pin 14, having a curved head section, which during assembly fits through aperture 43 of first spring 41, so that wings 26 abut against spring 41.

As shown in FIG. 2, also in hole 30 is a cam or eccentric rod 50, which is rotatable by a rotation device 52 as shown in FIG. 1. Rotation device 52 may be removable from rod 50, for example by a keyed arrangement, or may be fixed to rod 50. Device 52 may be hand or machine actuated.

The spring mechanism 40 comprising springs 41 and 42 shown in FIG. 2 is such that in the position shown in FIG. 2 pin 14 can slide axially, but with a slight resistance.

Figure 3:
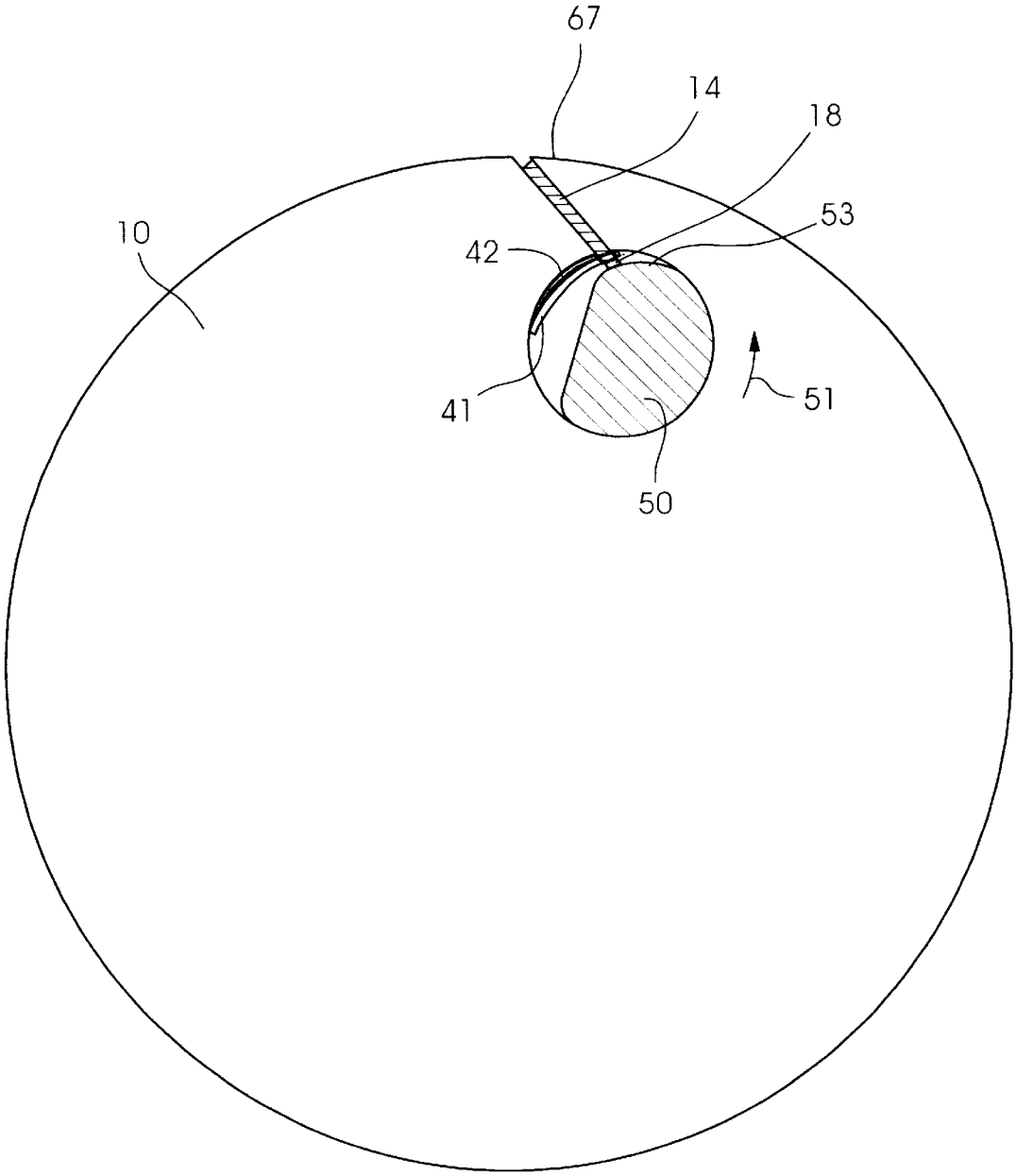
FIG. 3 shows the same view as FIG. 2 with the register pin in a locked position.

As shown in FIG. 3, when rod 50 is rotated in the direction of arrow 51 eccentric section 53 of rod 50 forces tail section 18 and wings 26 of pin 14 toward slot 20. Spring 41 is thus collapsed, as is spring 42, and pin 14 and springs 41, 42 are held firmly against the inner wall of hole 30 by eccentric section 53.

In this condition the pin 14 is locked. As shown in FIG. 1, the rod 50 extend through the entire plate cylinder 10 and thus locks or unlocks each register pin 12, 13, 14, 15. Once the register pins are locked, the plates 2, 3 and two similar others can be fastened on plate 10. Plates 2, 3 are in their proper axial registration due to the interaction of cut-outs 102, 103 with register pins 12, 13, respectively. This may occur for example by a lock-up mechanism in slot 20 located about the register pins. For example, plates 2, 3 can have a bent lead edge which fits in the slot 20 at the acute edge 67 as shown in FIG. 3, and the rest of the plate wraps circumferentially around the plate cylinder 10. The trail edge can then fit into the slot about the register pins, or remain unfastened.

Figure 4:
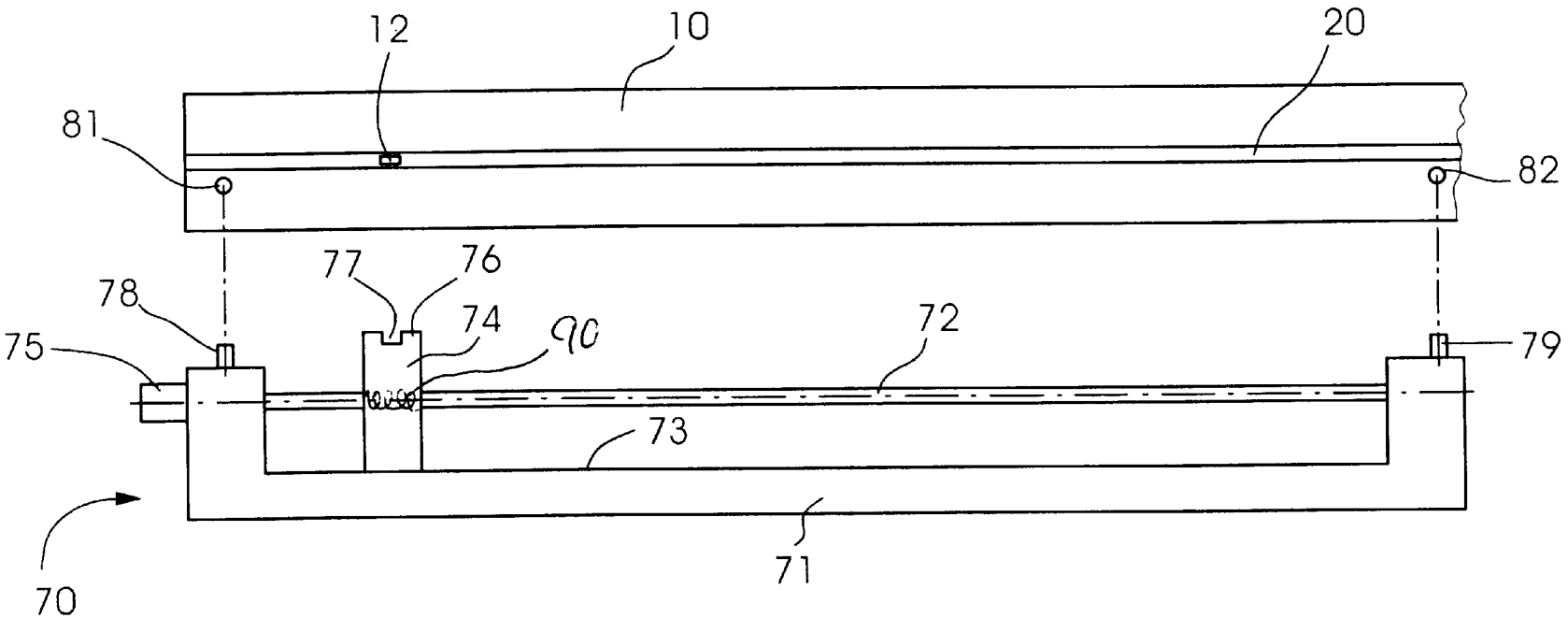
FIG. 4 shows an external registration device according to the present invention.

FIG. 4 shows an external registration device 70 of the present invention for moving one of the pins 12, 13, 14, 15 when the rod 50 is in an unlocked position. Device 70 has a base 71, in which a screw rod 72 is rotatably supported. A pin pusher 74 can slide along a surface 73 of base 71, but may not rotate with respect to base 71. Pin pusher 74 has a threaded interior hole with interior threads 90 which interacts with external threads of screw rod 72. Pin pusher 74 also has an insertion head 76 with a slot 77 for interaction with one of the register pins 12, 13, 14, 15. An adjustment knob 75 can rotate rod 72 to move pin pusher 74 axially.

Device 70 also has alignment pins 78, 79 which interact with alignment holes 81 and 82, as shown in FIGS. 1 and 4. The pins 78, 79 can also interact with holes 83, 84, and 85, 86 and 87, 88, as shown in FIG. 1 so that pin pusher 74 can interact with register pins 13, 14, and 15, respectively.

Figure 6:
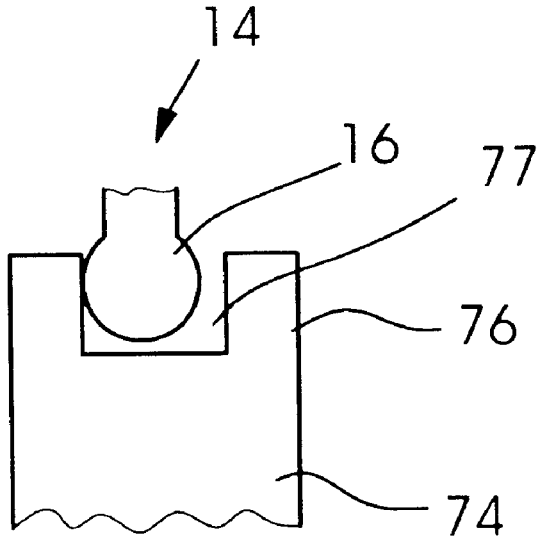
FIG. 6 shows the interaction of the register pin head with a pin pusher of the external registration device of FIG. 4.

FIG. 6 shows the interaction pin pusher 74 with pin 14. Device 70 thus would be inserted over slot 20 with pins 78, 79 fitting in holds 85, 86. Head 16 of pin 14 fits into slot 77 and is moved by insertion head 76 as adjustment knob 75 is rotated.

Once a desired register adjustment is complete, a plate can be attached to the cylinder 10.

Thus each register pin 12, 13, 14, 15 of plate cylinder 10 can be axially registered by device 70.

Figure 7:
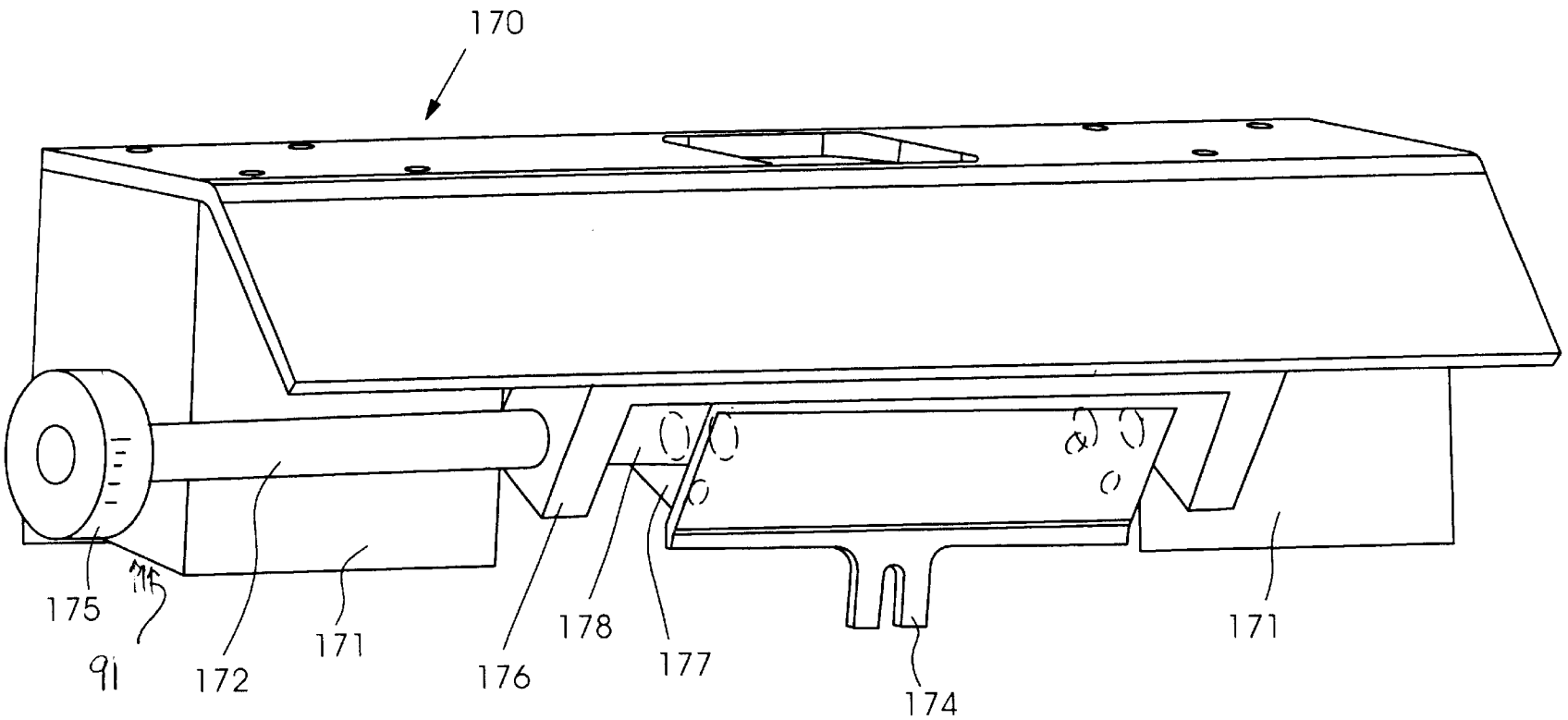
FIG. 7 shows an alternate embodiment of an external registration device.

FIG. 7 shows an alternate embodiment of an external registration device 170 having a magnetic base 171 fixedly attached to a support 176. Support 176 rotatingly supports a screw rod 172 which has a threaded outer section 178 between support 176, screw rod 172 having a knob 175. A nut section 177 has an interior threaded hole interacting with threaded outer section 178, permitting pin pusher 174 to move axially. The magnetic base 171 can be attached to cylinder based on alignment marks, thus removing the need for alignment pins and holes. However, the device 170 may also be provided with alignment pins if desired, the magnetic base adding to the stability of the device 170 when placed on cylinder 10.

As an alternative to a magnetic base, vacuum pressure 91 could be supplied at the base to aid in holding the device on the cylinder.

The desired stiffness of springs 71, 72 is a function of the hole shape and materials used.

While one register pin is shown for each plate, it could also be possible that more than one register pin could be used for each plate, and that the registration device would then have two or more pin pushers moving together at a fixed distance.

While a preferred multi-plate cylinder embodiment has been shown, the present invention may be used with a single-plate plate cylinder as well.

What is claimed is:

1. A plate cylinder comprising:

a cylinder body having at least one external slot extending axially with respect to the cylinder body; and at least one register pin slidable within the slot by an external registration device separated from the cylinder body during operation of the plate cylinder.

2. The plate cylinder as recited in claim 1 wherein the cylinder body has an axial hole and further comprising a rotatable actuator located within the axial hole for selectively locking the at least one register pin.

3. The plate cylinder as recited in claim 1 wherein the plate cylinder is a multi-plate plate cylinder and the at least one register pin includes at least two independently movable register pins.

4. The plate cylinder as recited in claim 1 wherein the cylinder body has location holes or markings for allowing proper placement of the external registration device.

5. A plate cylinder comprising:

a cylinder body having at least one external slot extending axially with respect to the cylinder body;

at least one register pin slidable within the slot; and a spring element connected to the at least one register pin.

6. The plate cylinder as recited in claim 5 wherein the spring element comprises two separate springs, a first spring being of low stiffness and a second spring of higher stiffness.

7. The plate cylinder as recited in claim 5 wherein the spring element has a spring element slot and the at least one register pin fits within the spring element slot.

8. A printing press comprising:

a plate cylinder having at least one external slot, the plate cylinder having a first register pin slidable in the slot; and a removable external registration device for sliding the first register pin within the slot and being separated from the plate cylinder during operation of the printing press.

9. The printing press as recited in claim 8 wherein the plate cylinder further includes a second register pin independently movable from the first register pin and also slidable by the external registration device.

10. An external registration device comprising:

a base for attaching to a circumferential surface of a plate cylinder; and a pin pusher interacting with a register pin in a slot of the plate cylinder, the pin pusher being axially movable relative to the base.

11. The device as recited in claim 10 further comprising location pins attached to the base.

12. The device as recited in claim 10 further comprising a magnetic section attached to the base.

13. The device as recited in claim 10 further comprising a rotatable rod supported in the base, the rotatable rod having external threads, wherein the pin pusher has internal threads interacting with the external threads.

14. The device as recited in claim 13 further comprising an adjustment knob attached to the rotatable rod.

15. The device as recited in claim 10 wherein the base is capable of providing vacuum pressure to attach to the plate cylinder.

16. A method for registering plates on a plate cylinder comprising the steps of:

placing an external registration device on an outer circumferential surface of a plate cylinder having at least one register pin, and moving the register pin axially with the external registration device.

17. The method as recited in claim 16 further including the step of providing a printing plate having a notch for interacting with the register pin to the plate cylinder.

18. The method as recited in claim 16 further comprising removing the external registration device, repositioning the external registration device on the plate cylinder, and moving another registration pin located in the plate cylinder.

* * * * *